US009938644B2

(12) United States Patent
Van Doorn

(10) Patent No.: US 9,938,644 B2
(45) Date of Patent: Apr. 10, 2018

(54) LINT CLEANER

(71) Applicant: Thomas W. C. Van Doorn, Sr., Parkville, MO (US)

(72) Inventor: Donald William Van Doorn, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 58 days.

(21) Appl. No.: 15/087,577

(22) Filed: Mar. 31, 2016

(65) Prior Publication Data

US 2017/0283991 A1 Oct. 5, 2017

(51) Int. Cl.
*D01G 9/06* (2006.01)
*D01G 9/04* (2006.01)

(52) U.S. Cl.
CPC ..... *D01G 9/06* (2013.01); *D01G 9/04* (2013.01)

(58) Field of Classification Search
CPC .. D01G 9/00; D01G 9/04; D01G 9/06; D01G 9/08; D01G 9/12; B07B 7/083; A01D 46/08
See application file for complete search history.

(56) References Cited

U.S. PATENT DOCUMENTS 3,457,595 A * 7/1969 Schulze ..... D01G 9/12 19/203
4,219,908 A * 9/1980 Winch ..... D01G 15/16 19/104
4,686,744 A * 8/1987 Shofner ..... D01B 1/04 16/200
5,381,587 A * 1/1995 Vandergriff ..... D01B 1/06 19/48 R
6,615,454 B1 * 9/2003 Anthony ..... D01G 9/06 19/200
2003/0208891 A1 * 11/2003 Mohammadi ..... D04H 1/46 28/103

FOREIGN PATENT DOCUMENTS

EP 0254694 A2 * 1/1988

* cited by examiner

*Primary Examiner* — Ismael Izaguirre
(74) *Attorney, Agent, or Firm* — Robert J. Veal

(57) ABSTRACT

An apparatus for cleaning trash from cotton lint utilizes a combing cylinder having a plurality of teeth covering its surface and extending therefrom in a manner to release the cotton lint to a cleaning cylinder. The combing cylinder surface moves slower than the cleaning cylinder to comb the lint as it is delivered to the cleaning cylinder. Means are provided to vary the speed of the combing cylinder to match the lint processing parameters, including negating lint combing all together.

21 Claims, 6 Drawing Sheets

LINT CLEANER

BACKGROUND OF THE INVENTION

The present invention relates to the field of cotton processing and represents a further improvement on the lint cleaners of U.S. Pat. Nos. 6,088,881 and 7,779,514 B2. U.S. Pat. No. 7,779,514B2 describes apparatus that reduces fiber damage by eliminating the formation of the cotton tufts into a batt, but rather, individually applies the tufts of cotton as they come from the gin stand in an airstream directly onto the teeth of the lint cleaner cleaning cylinder teeth without mechanically restraining the tufts. Such a device is for use with lint cleaners that have short, densely spaced teeth on a solid cylinder which currently are universally used in saw gins on upland cotton.

Other prior methods and apparatus include those such as illustrated in U.S. Pat. No. 6,088,881, incorporated herein by reference, wherein a revolving perforated drum is used to allow air flow through the drum such that a cleaning cylinder may remove cotton fiber from the perforated drum and carry it past a plurality of cleaning grid bars, thereby separating the airstream, and removing foreign matter from the fibers, before the fiber is doffed from the cleaning cylinder for subsequent air flow to downstream processing.

As mentioned above, U.S. Pat. Nos. 6,088,881 and 7,779,514 B2 have shown that they preserve the spinning quality of the lint, and countries that use scientific lint quality evaluation systems such as H.V.I. (High Volume Instrumentation) generally reward the lint produced on these lint cleaners. However, many countries and merchants value the well combed, "smooth" appearance above the H.V.I. evaluations, and thus the use of lint cleaners using the features of these patents has been somewhat limited.

SUMMARY OF THE PRESENT INVENTION

The Objects of this Invention are:

To increase the combed, smooth appearance of the lint produced.

To increase the color grade of the lint produced.

To reduce the trash content of the lint produced.

To accomplish the above objects without substantially increasing lint fiber breakage and nepping.

To make the degree of combing variable in response to manual or automatic control means.

These and other objects and advantages of the invention will become apparent from the following detailed description of the preferred embodiment of the invention.

BRIEF DESCRIPTION OF THE DRAWINGS

An apparatus for cleaning lint is depicted in the accompanying drawings which form a portion of this disclosure and wherein.

DESCRIPTION OF THE PREFERRED EMBODIMENT

Figure 1:
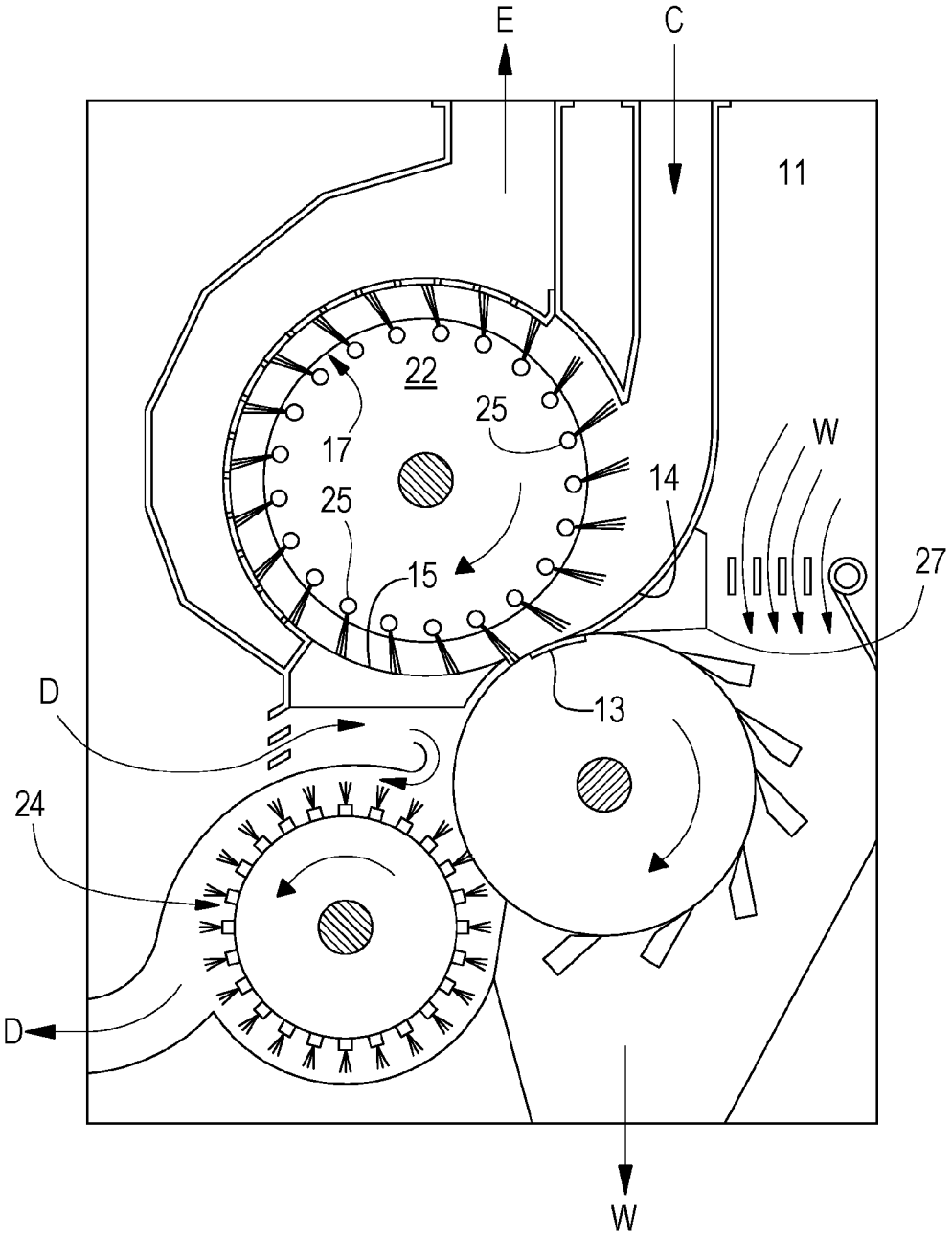
FIG. 1 Prior Art
FIG. 1, is a sectional view of the apparatus of prior art U.S. Pat. No. 7,779,514 B2.

In the prior art shown in FIG. 1, the bulk of the tufts carried by an airstream flow directly across the top surface of streamer plate 14 and are abruptly whipped over the tip of the plate by the aggressive teeth 13 of cleaning cylinder 12. This action produces a minimum amount of "opening" of the lint tufts. The smaller number of entering lint tufts that are drawn into the separator cylinder 22 between the brushes move to the perforated screen surrounding cylinder 22 and are swept by the brushes around to plate 14 to also receive a minimum amount of opening.

Figure 2:
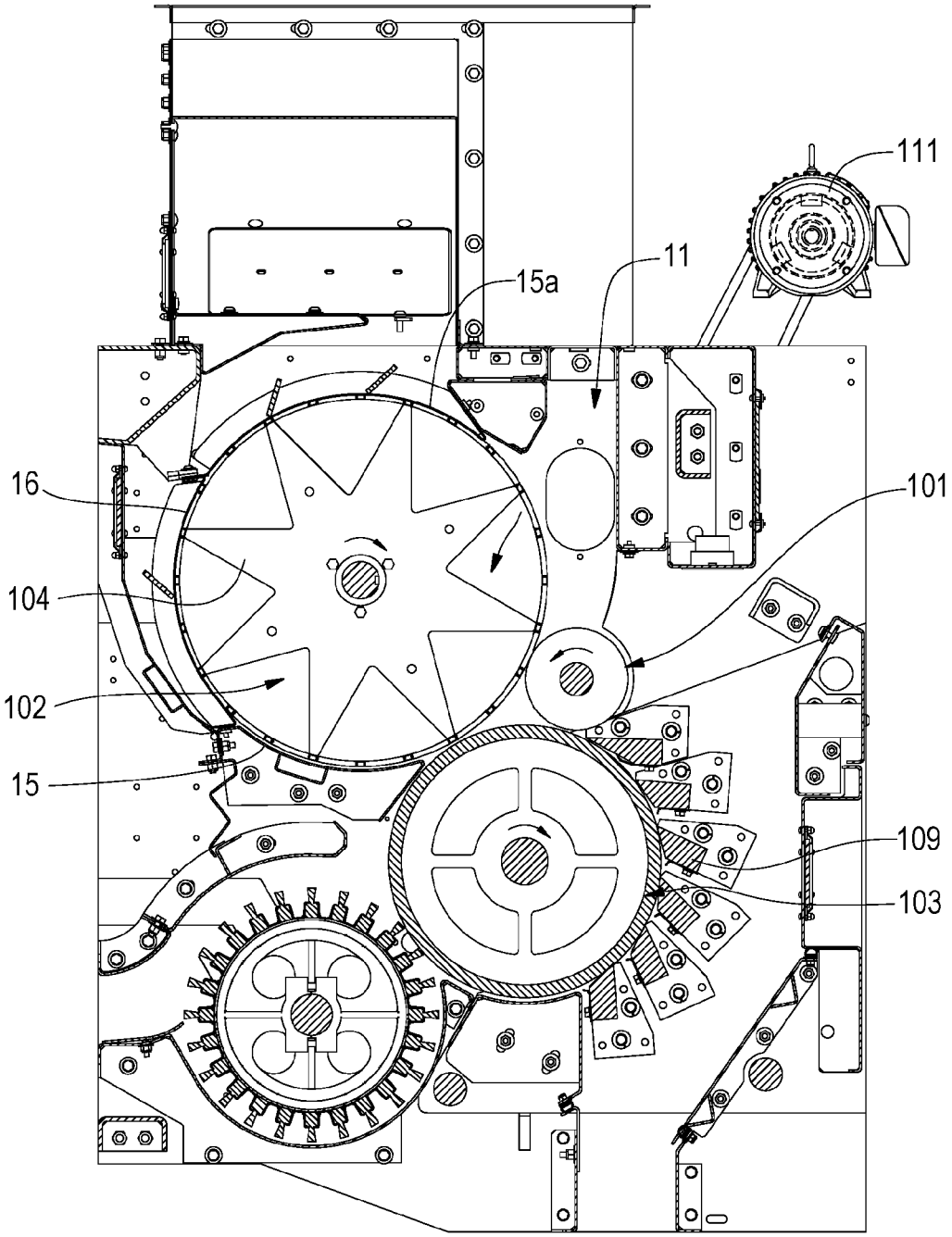
FIG. 2, is a sectional view of a Preferred Embodiment of present invention.

FIG. 2 is a cross section drawing of a preferred embodiment of the present invention. As the lint tufts enter the machine at duct 11 at the upper right the bulk of them are thrown against the upper surface of a slowly counter-clockwise rotating combing cylinder 101. Air duct 11 terminates adjacent an outer surface of revolving combing cylinder 101 and a stationary separator housing and delivers the majority of the tufts to the combing cylinder 101 whose surface is covered with fine, closely spaced teeth 105 that impale some of the fibers against the leftward moving air stream flowing into the large air separator 102.

Figure 4A:
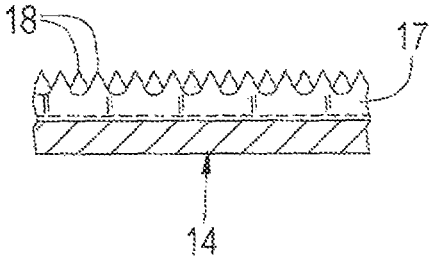
FIG. 4A, is a partial side elevational view substantially tangent to the surface of the Air Separator Cylinder showing the Preferred Toothed Axial Channels spaced around Air Separator Cylinder.
Figure 4B:
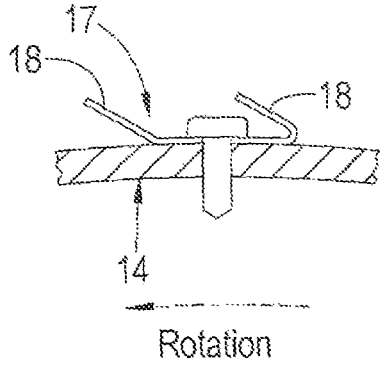
FIG. 4B is an end view of a Preferred Toothed Axial Channel shown in FIG. 4A.

An air separator 102 includes an air separator creel 104 circumscribed by a cylindrical housing formed by a perforated surface or section 16, and non-porous segment 15 and 15*a* such that the cylindrical housing is open to duct 11 opposite combing cylinder 101. Perforated section 16 is a stationary separator that is porous to airflow there through but impervious to desirable fiber flow there through. Rotating within the cylindrical housing is revolving air separator creel 104 which is pervious to both fiber and foreign matter. The described air separator creel 104 and cylindrical housing are similar in construction to the air separator taught in commonly owned U.S. Pat. No. 7,779,514 B2 and incorporated herein by reference, however, instead of brushes the air separator of the present invention utilizes a series of axially aligned channels 17 bearing substantially radially extending teeth 18 which pass near the cylindrical housing and combing cylinder 101. The surface of the high speed air separator creel 104 may be described as having peripherally equally spaced apart, substantially axial rows of sharp teeth completely surrounding it. The details of these teeth should further be described as axial channel saws whose legs project substantially radially outward or slightly forward leaning in the direction of rotation as shown in FIGS. 4A and 4B.

Figure 3:
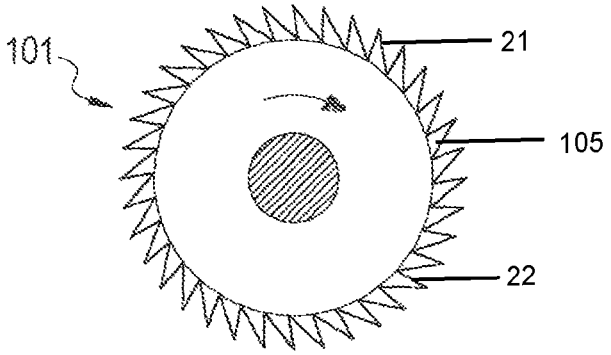
FIG. 3, is an end view of a Preferred Combing Cylinder.

Cleaning cylinder 103 generally rotates in a clockwise direction such that the surface of cleaning cylinder 103 and combing cylinder 101 travel in the same direction at their closest point of approach. All of the fiber passing through the machine must pass between cylinders 101 and 103 in this region. Referring to FIG. 3, note that the size of the teeth 105 are exaggerated to show their profile. The fine teeth 105 on the combing cylinder are aggressive when converging towards the cleaning cylinder 103 but are not aggressive when diverging therefrom. That is to say, the narrow, sharp pointed, closely or densely spaced, uniquely shaped teeth on the combing cylinder 101 comb against the aggressive teeth of the cleaning cylinder 103 as their surfaces converge, but yield substantially all the fibers to the aggressive cleaning cylinder 103 as their surfaces diverge. In normal combing operation the slowly turning combing cylinder 101 only holds a small percentage of the incoming tufts, letting the bulk of the tufts to be impaled on the outward facing fine teeth 18 on the axial channel 17 on the air separator cylinder 102 or pass between the channel strips and accumulate on the perforated section 16 surrounding the air separator cylinder 102 where the channel teeth 18 impale the tufts and sweep them back across the aggressive facing, slow turning combing cylinder 101 for the first combing action. Some of the fibers are impaled on the channel teeth 18 where they are carried around to the cleaning cylinder 103 surface where they receive a combing action against the cleaning cylinder, but the very aggressive cleaning cylinder 103 saw handily carries them around to join the fibers that were impaled on the combing cylinder 101 for the major combing action between the combing cylinder 101 and cleaning cylinder 103. The teeth on the combing cylinder 101, as stated earlier, have faces 21 that are aggressive against converging to tangential greater surface movement, but the combing cylinder tooth faces 22 are near radial to become non aggressive as they pass tangential with another aggressive faster rotating surface. Thus, as the combed fibers pass the tangent point between the combing cylinder 101 and the cleaning cylinder 103, the combing cylinder teeth become non-aggressive and the very aggressive teeth on the cleaning cylinder 103 pull the fibers away from the combing cylinder. As with prior art lint cleaners, adjustable "lint savers" are furnished to reapply the looser fibers to the cleaner cylinder teeth before each grid bar 109.

An object of this invention is to make the degree of combing variable in response to manual or automatic control means. The degree of combing is a function of the surface speed of the combing cylinder 101 and that of the cleaning cylinder 103 and air separator cylinder 102, both of which may have fixed speeds. The surface of the combing cylinder 101 moves in the same direction as both the air separator cylinder 102 and cleaning cylinder 103 at convergence, thus the slower the combing cylinder surface moves relative to the other cylinders, the greater the degree of combing. Conversely, the relatively faster the combing cylinder surface moves, the less the degree of combing until, at the same surface speeds, the combing cylinder becomes only a transfer cylinder. This condition is an option that may be desirable under some conditions.

Figure 7:
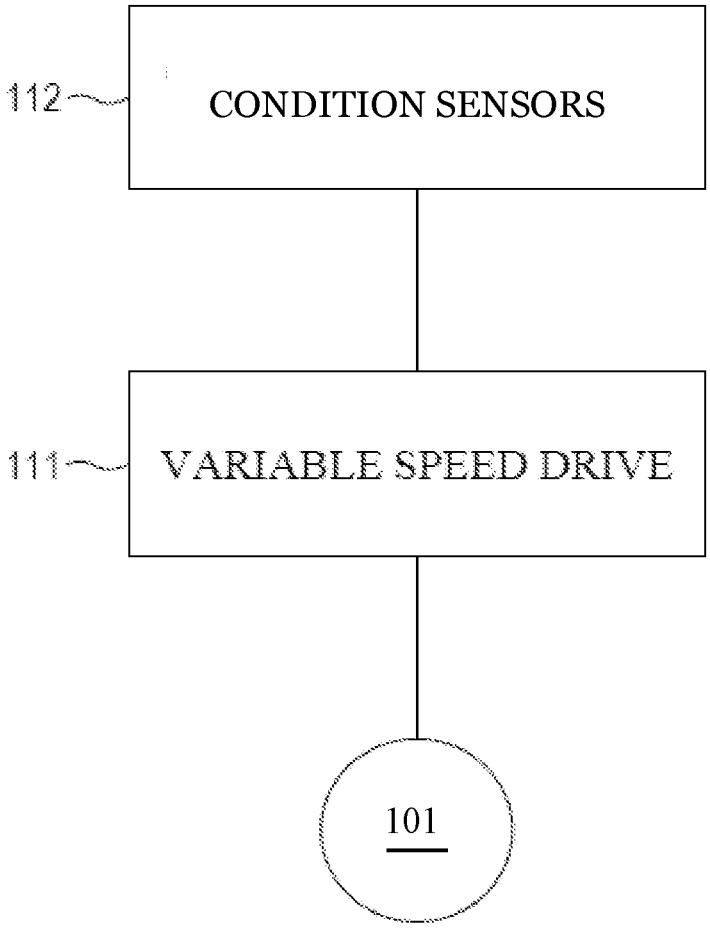

This variable combing cylinder surface speed can be accomplished by the use of various well known mechanical or electrical drives. As shown in FIG. 7, the automatic function can be accomplished by combining an electric motor 111 employing a variable speed drive input with the output signal from any of various well known electrical, in process, lint cotton condition sensors 112 on the market such as moisture sensors or sample color, trash or grade sensors located inside or outside the gin plant sensing these and other parameters affecting the optimum level of combing. This is also accomplished by driving the combing cylinder 101 by other means that vary the comber cylinder speed without changing the speeds of the other cylinders. This can be as simple as a separate V-belt drive to the combing cylinder incorporating a mechanical variable pitch diameter sheave. It should also be understood that the effectiveness of the combing action is not only determined by the relative surface speeds of the combing cylinder and the adjacent toothed cylinder, but also the density of the fibers passing between the adjacent cylinders. Therefore, the major combing action takes place between the combing cylinder and the cleaning cylinder where all the fibers simultaneously must pass. Furthermore, this major combing action is influenced by the processing rate; the faster the processing rate at a given combing cylinder speed, the more effective the combing. There are various conditions causing the ginning rate to change, but a catch all rate detector, such as a gin feeder feed roll speed detector used to modulate the speed of the combing cylinder 101 is another combing cylinder speed control option that can be employed. These features open the way for an important development in the cotton ginning industry—variable combing of the raw cotton without delaying the ginning process.

Figure 5:
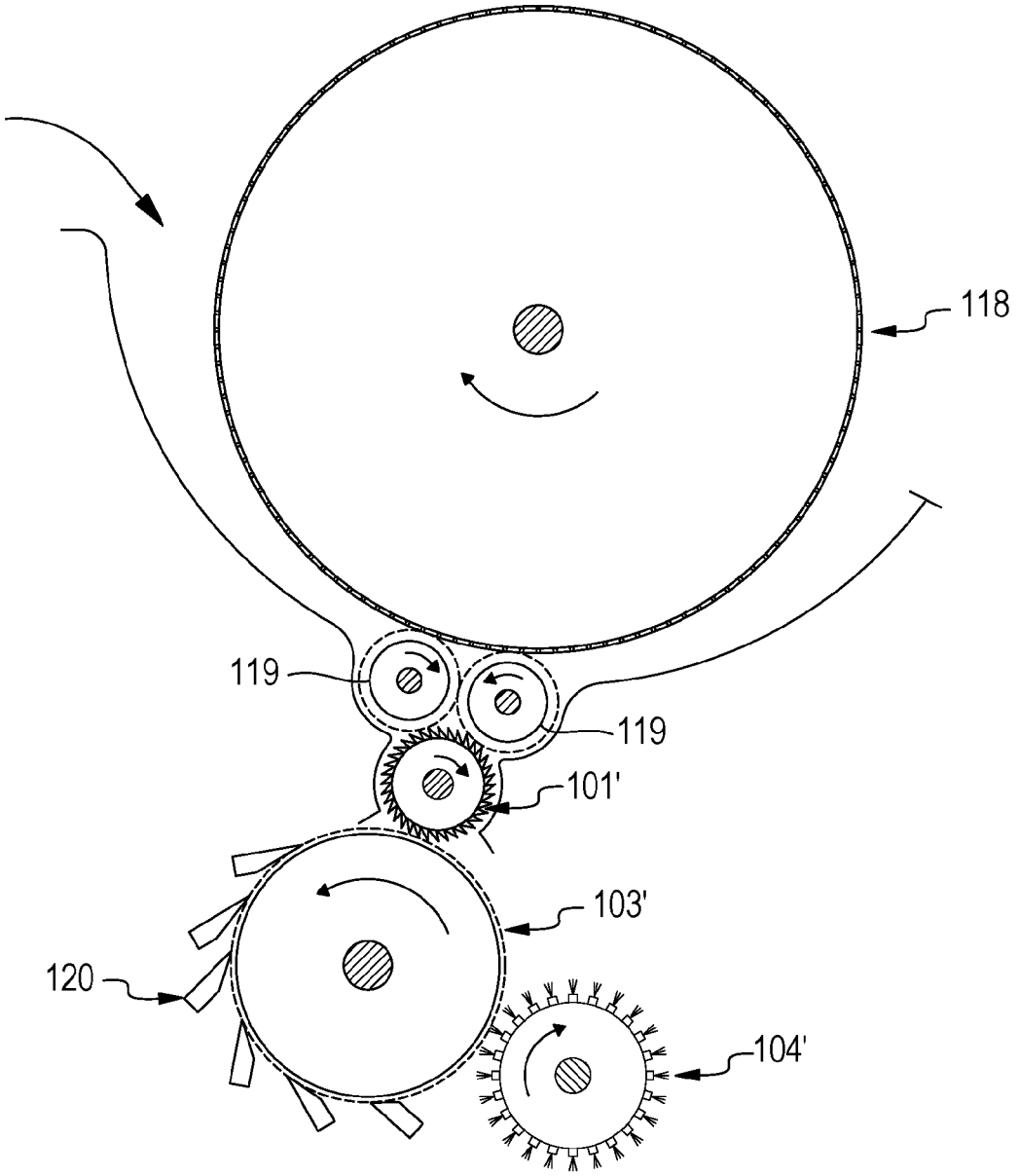
FIG. 5, is a partial sectional view of a second embodiment used as a retrofit to an existing lint cleaner.
Figure 6:
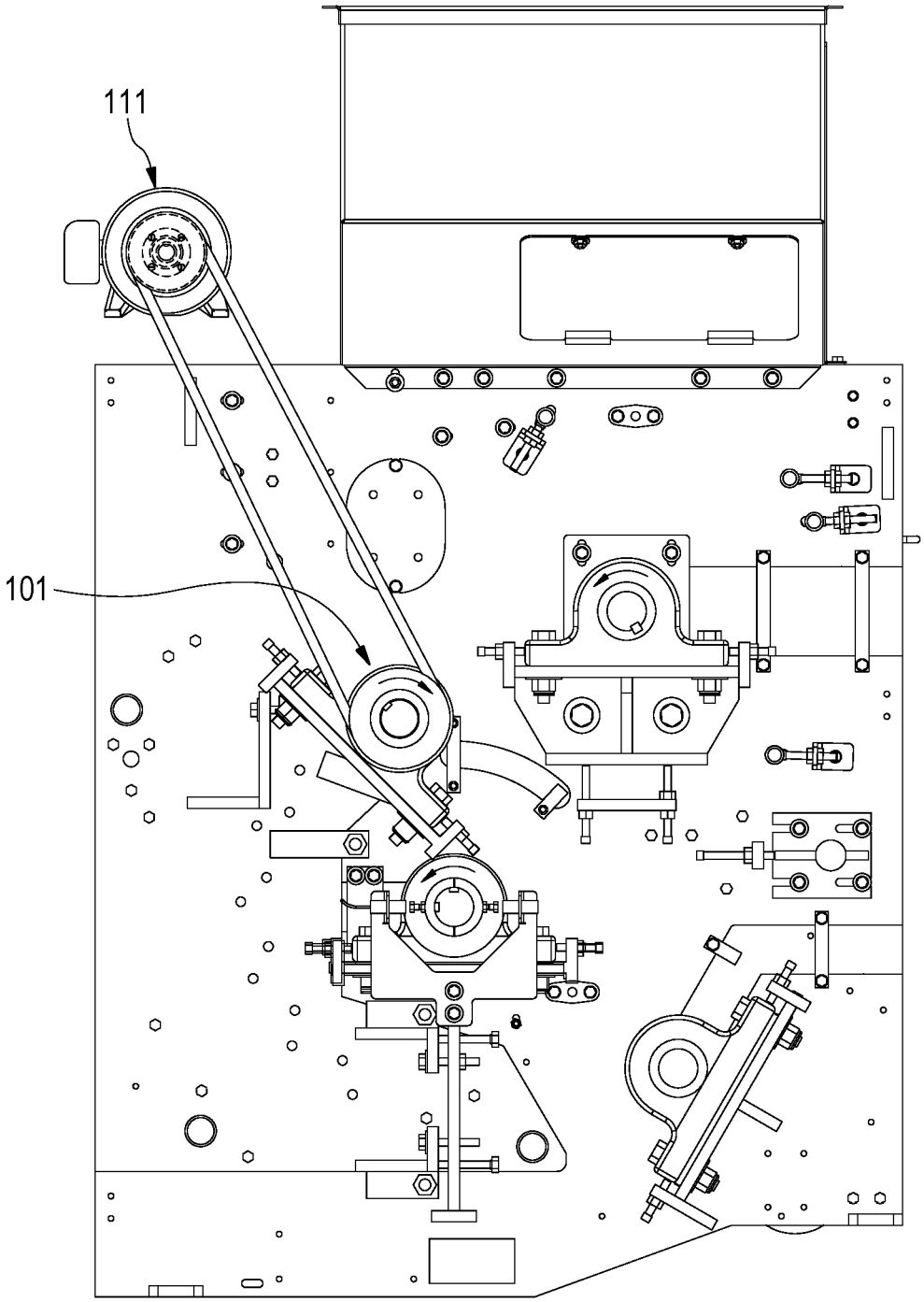
FIG. 6 is a rear view of the housing of the lint cleaner showing the variable drive for the combing roller; and, FIG. 7 is a schematic view of a drive control system for the apparatus.

Another embodiment of the invention, shown in FIG. 5, provides the benefits of a variable speed combing cylinder to a different style lint cleaner, wherein the lint and commingled trash are delivered in an air stream to slow turning perforated condenser drum 118. The relatively slowly turning condenser drum 118 causes the cotton lint and commingled trash to build up on the surface of the drum sufficiently thick to form a cohesive batt that is pressed together and doffed from the drum by a pair of doffing rollers 119. The batt is then fed down to the low speed combing cylinder 101' with its negative draft teeth which comb the lint batt as it is carried forward by the cleaning cylinder and releases the lint to the aggressive teeth of the cleaning cylinder 103' as the cylinders diverge. The lint fibers are impaled on the surface of the toothed cleaning cylinder which carries fibers and trash over a series of grid bars 120 that have acute angle leading edges over which the lint is whipped, thus causing much of the trash and entangled fiber to be slung off by centrifugal force where it drops down into trash conveyor system 130, as is well known. As cleaning cylinder 103 continues to turn past the grid bars 120, it moves in close proximity to doffing brush 104' whose surface at the point of close proximity moves faster than the surface of the cleaning cylinder. It should be understood that the combing action in this embodiment is a function of the surface speed of the combing cylinder 101' and that of the cleaning cylinder 103', thus the above described control of the speed of the combing cylinder 101 is applicable to combing cylinder 101'.

It is to be understood that the forms of the invention shown are preferred embodiments thereof and that various changes and modifications may be made therein without departing from the spirit of the invention or scope as defined in the following claims.

What is claimed is:

1. An apparatus for cleaning and combing lint cotton entering the apparatus in an airstream commingled with foreign matter, comprising a combing cylinder closely adjacent a cleaning cylinder said combing cylinder covered with sharp pointed, closely spaced teeth with a draft side thereof extending substantially radially from said combing cylinder, said cleaning cylinder and said combing cylinder each mounted for rotation about parallel axes such that the proximal surfaces of said combing cylinder and said cleaning cylinder move in the same direction with the surface of said cleaning cylinder moving faster than an adjacent surface of said combing cylinder, said combing cylinder positioned to remove lint cotton from said airstream and to deliver said removed lint cotton to said cleaning cylinder and provide a combing action to said cotton as it passes between said combing and cleaning cylinders.

2. Apparatus as defined in claim 1 further comprising a variable speed drive connected to said combing cylinder to rotate said cylinder at a rate which is variable with one or more selected ginning parameters.

3. Apparatus as defined in claim 2 further comprising one or more control sensors having an output to a speed control circuit for responsively varying the speed of said combing cylinder and operably positioned to monitor parameters selected from a group consisting of: lint moisture, lint color, lint trash content, lint grade, or lint throughput.

4. Apparatus as defined in claim 2 further comprising one or more control sensors having an output to a speed control circuit of a variable speed drive for responsively varying the speed of said combing cylinder and operably positioned to monitor parameters including one or more of lint moisture, lint color, lint trash content, lint grade, or lint throughput.

5. An Apparatus for cleaning and combing lint cotton entering the apparatus in an airstream commingled with foreign matter, comprising a combing cylinder closely adjacent a cleaning cylinder said combing cylinder covered with sharp pointed, closely spaced teeth with a draft side thereof extending substantially radially from said combing cylinder, said cleaning cylinder and said combing cylinder each mounted for rotation about parallel axes such that the proximal surfaces of said combing cylinder and said cleaning cylinder move in the same direction with the surface of said cleaning cylinder moving faster than an adjacent surface of said combing cylinder, said combing cylinder positioned to deliver lint cotton from said airstream to said cleaning cylinder and provide a combing action to said cotton as it passes between said combing and cleaning cylinders, a variable speed drive connected to said combing cylinder to rotate said cylinder at a rate which is variable with one or more selected ginning parameters, and, further comprising a gin feeder feed roll speed detector operably connected control said variable speed drive for said combing cylinder.

6. Apparatus as defined in claim 2 wherein said variable speed drive comprises an electric motor variable speed drive.

7. An Apparatus for cleaning and combing lint cotton entering the apparatus in an airstream commingled with foreign matter, comprising a combing cylinder closely adjacent a cleaning cylinder said combing cylinder covered with sharp pointed, closely spaced teeth with a draft side thereof extending substantially radially from said combing cylinder, said cleaning cylinder and said combing cylinder each mounted for rotation about parallel axes such that the proximal surfaces of said combing cylinder and said cleaning cylinder move in the same direction with the surface of said cleaning cylinder moving faster than an adjacent surface of said combing cylinder, said combing cylinder positioned to deliver lint cotton from said airstream to said cleaning cylinder and provide a combing action to said cotton as it passes between said combing and cleaning cylinders, a variable speed drive connected to said combing cylinder to rotate said cylinder at a rate which is variable with one or more selected ginning parameters, wherein said variable speed drive comprises a separate V-belt drive to the combing cylinder incorporating a mechanical variable pitch diameter sheave.

8. An Apparatus for cleaning and combing lint cotton entering the apparatus in an airstream commingled with foreign matter, comprising a combing cylinder closely adjacent a cleaning cylinder said combing cylinder covered with sharp pointed, closely spaced teeth with a draft side thereof extending substantially radially from said combing cylinder, said cleaning cylinder and said combing cylinder each mounted for rotation about parallel axes such that the proximal surfaces of said combing cylinder and said cleaning cylinder move in the same direction with the surface of said cleaning cylinder moving faster than an adjacent surface of said combing cylinder, said combing cylinder positioned to deliver lint cotton from said airstream to said cleaning cylinder and provide a combing action to said cotton as it passes between said combing and cleaning cylinders, a variable speed drive connected to said combing cylinder to rotate said cylinder at a rate which is variable with one or more selected ginning parameters, and further comprising an air separator positioned in said air stream upstream of said combing cylinder to divert substantially all of the air in said air stream away from said combing cylinder and any lint carried on said combing cylinder.

9. Apparatus as defined in claim 8 wherein said air separator is a revolving perforated drum having a vacuum outlet therein drawing air through perforations formed in the drum and retaining lint cotton on the exterior thereof, said drum mounted for rotation adjacent at least one doffing roller removing said retained lint cotton and directing it to said combing cylinder.

10. Apparatus as defined in claim 8 wherein said air separator is a rotating frame mounted adjacent a pervious screen partially circumscribing the periphery of said frame, said frame having a plurality of having peripherally equally spaced apart, substantially axial rows of sharp teeth completely surrounding the frame and passing closely adjacent said pervious screen and said combing cylinder and an air removal outlet drawing air through said pervious screen and said frame such that lint cotton is deposited on said combing cylinder and said pervious screen with any lint cotton deposited on said screen being swept toward said combing cylinder by said rows of teeth.

11. Apparatus as defined in claim 2 wherein said cleaning cylinder is covered with sharp, closely spaced, aggressive, pointed teeth angled forward in the direction of the cylinder rotation and large enough to accommodate conventional lint cleaner grid bars and a doffing cylinder.

12. An apparatus for cleaning and combing lint cotton entering the apparatus in an air stream commingled with foreign matter, comprising a combing cylinder closely adjacent a cleaning cylinder each mounted for rotation about parallel axes such that proximal surfaces of said combing cylinder and said cleaning cylinder move in the same direction, with the surface of said cleaning cylinder moving faster than the surface of said combing cylinder, a variable speed drive connected to said combing cylinder to rotate said cylinder at a rate variable with one or more selected ginning parameters, said combing cylinder positioned to remove lint cotton from said airstream and to deliver said removed lint cotton to said cleaning cylinder and provide a combing action to said cotton as it passes between said cylinders.

13. Apparatus as defined in claim 12 wherein combing cylinder is covered with sharp pointed, closely spaced teeth with a draft side thereof extending substantially radially from said combing cylinder.

14. Apparatus as defined in claim 13 wherein said cleaning cylinder is covered with sharp, closely spaced, aggressive, pointed teeth angled forward in the direction of rotation of said cleaning cylinder and large enough to accommodate conventional lint cleaner grid bars and a doffing cylinder.

15. An apparatus for cleaning and combing lint cotton entering the apparatus in an air stream commingled with foreign matter, comprising a combing cylinder closely adjacent a cleaning cylinder each mounted for rotation about parallel axes such that proximal surfaces of said combing cylinder and said cleaning cylinder move in the same direction, with the surface of said cleaning cylinder moving faster than the surface of said combing cylinder, a variable speed drive connected to said combing cylinder to rotate said cylinder at a rate variable with one or more selected ginning parameters, said combing cylinder positioned to deliver lint cotton from said airstream to said cleaning cylinder and provide a combing action to said cotton as it passes between said cylinders, further comprising one or more control sensors operably positioned to monitor lint moisture, lint color, lint trash content, lint grade, or lint throughput with said control sensors having an output to a speed control circuit for responsively varying the speed of said combing cylinder.

16. Apparatus as defined in claim 12 further comprising a gin feeder feed roll speed detector operably connected to control said variable speed drive for said combing cylinder.

17. Apparatus as defined in claim 12 wherein said variable speed drive comprises an electric motor variable speed drive.

18. An apparatus for cleaning and combing lint cotton entering the apparatus in an air stream commingled with foreign matter, comprising a combing cylinder closely adjacent a cleaning cylinder each mounted for rotation about parallel axes such that proximal surfaces of said combing cylinder and said cleaning cylinder move in the same direction, with the surface of said cleaning cylinder moving faster than the surface of said combing cylinder, a variable speed drive connected to said combing cylinder to rotate said cylinder at a rate variable with one or more selected ginning parameters, said combing cylinder positioned to deliver lint cotton from said airstream to said cleaning cylinder and provide a combing action to said cotton as it passes between said cylinders wherein said variable speed drive comprises a separate V-belt drive to the combing cylinder incorporating a mechanical variable pitch diameter sheave.

19. An apparatus for cleaning and combing lint cotton entering the apparatus in an air stream commingled with foreign matter, comprising a combing cylinder closely adjacent a cleaning cylinder each mounted for rotation about parallel axes such that proximal surfaces of said combing cylinder and said cleaning cylinder move in the same direction, with the surface of said cleaning cylinder moving faster than the surface of said combing cylinder, a variable speed drive connected to said combing cylinder to rotate said cylinder at a rate variable with one or more selected ginning parameters, said combing cylinder positioned to deliver lint cotton from said airstream to said cleaning cylinder and provide a combing action to said cotton as it passes between said cylinders further comprising an air separator positioned in said air stream upstream of said combing cylinder to divert substantially all of the air in said air stream away from said combing cylinder and any lint carried on said combing cylinder.

20. Apparatus as defined in claim 19 wherein said air separator is a revolving perforated drum having a vacuum outlet therein drawing air through perforations formed in the drum and retaining lint on the exterior thereof, said drum mounted for rotation adjacent at least one doffing roller removing said retained lint and directing it to said combing cylinder.

21. Apparatus as defined in claim 19 wherein said air separator is a rotating frame mounted adjacent a pervious screen partially circumscribing the periphery of said frame, said frame having a plurality of having peripherally equally spaced apart, substantially axial rows of sharp teeth completely surrounding the frame and passing closely adjacent said pervious screen and said combing cylinder and an air removal outlet drawing air through said pervious screen and said frame such that lint is deposited on said combing cylinder and said pervious screen with any lint deposited on said screen being swept toward said combing cylinder by said rows of teeth.

* * * * *